US006182821B1

(12) United States Patent
Olsen

(10) Patent No.: US 6,182,821 B1
(45) **Date of Patent: *Feb. 6, 2001**

(54) DIVISIBLE CONTAINER CARRIER

(75) Inventor: Robert Olsen, Medinah, IL (US)

(73) Assignee: Illinois Tool Works Inc., Glenview, IL (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/198,838

(22) Filed: Nov. 24, 1998

(51) Int. Cl.[7] ..... B65D 75/00

(52) U.S. Cl. ..... 206/150; 206/427; 206/459.5; 294/87.2

(58) Field of Search ..... 206/147, 150, 206/153, 158, 192, 199, 427, 459.5, 428; 294/87.2

(56) References Cited

U.S. PATENT DOCUMENTS

| | | | | |
|---|---|---|---|---|
| 2,098,090 | * | 11/1937 | Ford | 206/459.5 |
| 3,038,602 | | 6/1962 | Rapata . | |
| 3,085,682 | | 4/1963 | Poupitch . | |
| 3,086,651 | | 4/1963 | Poupitch . | |
| 3,314,712 | * | 4/1967 | Hohl et al. | 206/150 |
| 3,515,272 | * | 6/1970 | Von Gal | 206/192 |
| 3,734,278 | | 5/1973 | Kerrigan et al. . | |
| 3,784,003 | * | 1/1974 | Bolton | 294/87.2 |
| 4,018,331 | | 4/1977 | Klygis . | |
| 4,232,807 | * | 11/1980 | Beier et al. | 206/151 |
| 4,269,308 | | 5/1981 | Platt . | |
| 4,385,691 | | 5/1983 | Klygis . | |
| 4,487,312 | | 12/1984 | Heider . | |
| 4,518,081 | | 5/1985 | de Larosiere . | |
| 5,018,620 | | 5/1991 | Marco et al. . | |
| 5,038,928 | * | 8/1991 | Marco et al. | 206/162 |
| 5,072,829 | * | 12/1991 | Marco et al. | 206/162 |
| 5,261,530 | * | 11/1993 | Marco | 206/150 |
| 5,535,879 | * | 7/1996 | Appleton | 206/150 |
| 5,544,749 | * | 8/1996 | Watts | 206/459.5 |
| 5,651,453 | * | 7/1997 | Olsen | 206/150 |
| 5,653,334 | * | 8/1997 | Marco | 206/150 |
| 5,868,659 | * | 2/1999 | Slomski | 493/374 |

FOREIGN PATENT DOCUMENTS

| | | |
|---|---|---|
| 0 507 479 | 10/1992 | (EP) . |
| 0 514 108 | 11/1992 | (EP) . |
| 0 728 674 | 8/1996 | (EP) . |

* cited by examiner

*Primary Examiner*—Paul T. Sewell
*Assistant Examiner*—Shian Luong
(74) *Attorney, Agent, or Firm*—Pauley Petersen Kinne & Fejer

(57) ABSTRACT

This invention relates to a package of a plurality of containers unitized with a flexible container carrier. The carrier is constructed from a plastic planar sheet having a plurality of container receiving openings. At least one handle is integrally formed with the sheet and removable along a handle tear line. A carrier tear line extends across the sheet and enables the package to be divided into sub-packages depending upon merchandising requirements. One or more handles are removed along the handle tear line, depending on the required configuration of the package.

20 Claims, 3 Drawing Sheets

DIVISIBLE CONTAINER CARRIER

BACKGROUND OF THE INVENTION

1. Field of the Invention

This invention relates to a carrier for carrying a plurality of containers in a package having handle and carrier tear lines for dividing the container carrier into one or more packages.

2. Description of Prior Art

Conventional container carriers are often used to unitize a plurality of similarly sized containers, such as cans, bottles, jars and boxes, although other packages or containers may be unitized. Conventional container carriers are typically configured to hold 6 containers ("6 pack"), 12 containers ("12 pack") or 24 containers ("case"), although many other multi-package configurations are possible.

One problem encountered with conventional multi-packages, such as 6 packs and 12 packs, is a lack of flexibility for the merchandiser. If the merchandiser stocks only 12 packs, then the consumer cannot purchase a smaller package. Likewise, if the merchandiser stocks only 6 packs, the consumer cannot purchase larger packages at a discount typically associated with such larger packages. This merchandising problem is especially acute for smaller, low-volume merchandisers which do not have the shelf space or the inventory capabilities to stock multiple sizes of multi-packages.

Merchandisers have attempted several solutions of the above problem. Some merchandisers use a utility knife to cut 12 packs in half, resulting in an unstable package, often without an effective handle for the consumer. Some merchandisers purchase multiple cardboard flats of loose containers and re-package the containers on the premises according to demand. This procedure is time consuming and also results in unstable and inconsistent multi-packages.

Both of the above inadequate solutions also result in multi-packages that must be re-priced according to the size of the multi-package. Often UPC symbols or other means of pricing reflect the price of the previously sized multi-package, thus resulting in improper scans and incorrect labeling of the re-packaged multi-package.

SUMMARY OF THE INVENTION

It is one object of this invention to provide a container carrier that unitizes a plurality of containers into a tight, solid and divisible package.

It is another object of this invention to provide a container carrier that provides separable pricing information for at least two sizes of multi-packages.

It is still another object of this invention to provide a package which is quickly and clearly divisible into at least two sub-packages.

It is another object of this invention to provide a divisible package and divided sub-packages that are easy to carry.

A carrier according to this invention is preferably used to unitize multiple containers into a package. The carrier preferably comprises a flexible, resilient planar sheet of plastic having a first edge, a second edge and two lateral edges.

The sheet is preferably formed with a plurality of container receiving openings in sheet. The carrier further comprises a carrier tear line extending across the sheet. The carrier tear line is preferably a line of perforations through the sheet.

The carrier further comprises at least one handle integrally formed with the sheet. The handles are preferably positioned along the first edge and/or the second edge of the sheet. The carrier preferably comprises three handles: two handles along the first edge of the sheet and one handle along the second edge of the sheet.

Each handle preferably includes a label or other means for pricing the package. The labels may contain different pricing information depending upon the size of the intended package.

The handle is removable along a handle tear line. The handle tear lines are preferably formed between each handle and the sheet. The handle tear line may be formed with a series of perforations, preferably having an unequal distribution, through the sheet. A pull tab may be integrally formed with the sheet to facilitate tearing of the handle tear line.

After the carrier is filled with containers, the package may be adjusted for sale of the package or divided for sale of multiple sub-packages. If a large package is required then one or more smaller handles are removed from the package along the handle tear line. The package is then priced on the label on the remaining handle.

If one or more smaller packages are required, then one or more larger handles are removed along the respective handle tear line. The package is then divided along the carrier tear line into two or more smaller sub-packages. Each sub-package is then independently priced on the label on the two or more remaining handles.

In the above manner, a merchandiser may purchase a single package that has multiple flexible merchandising possibilities. No tools are required for conversion of the single package into sub-packages and the conversion is time-efficient. Most importantly, the package and any resulting sub-packages are tight, solid and easy to carry.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
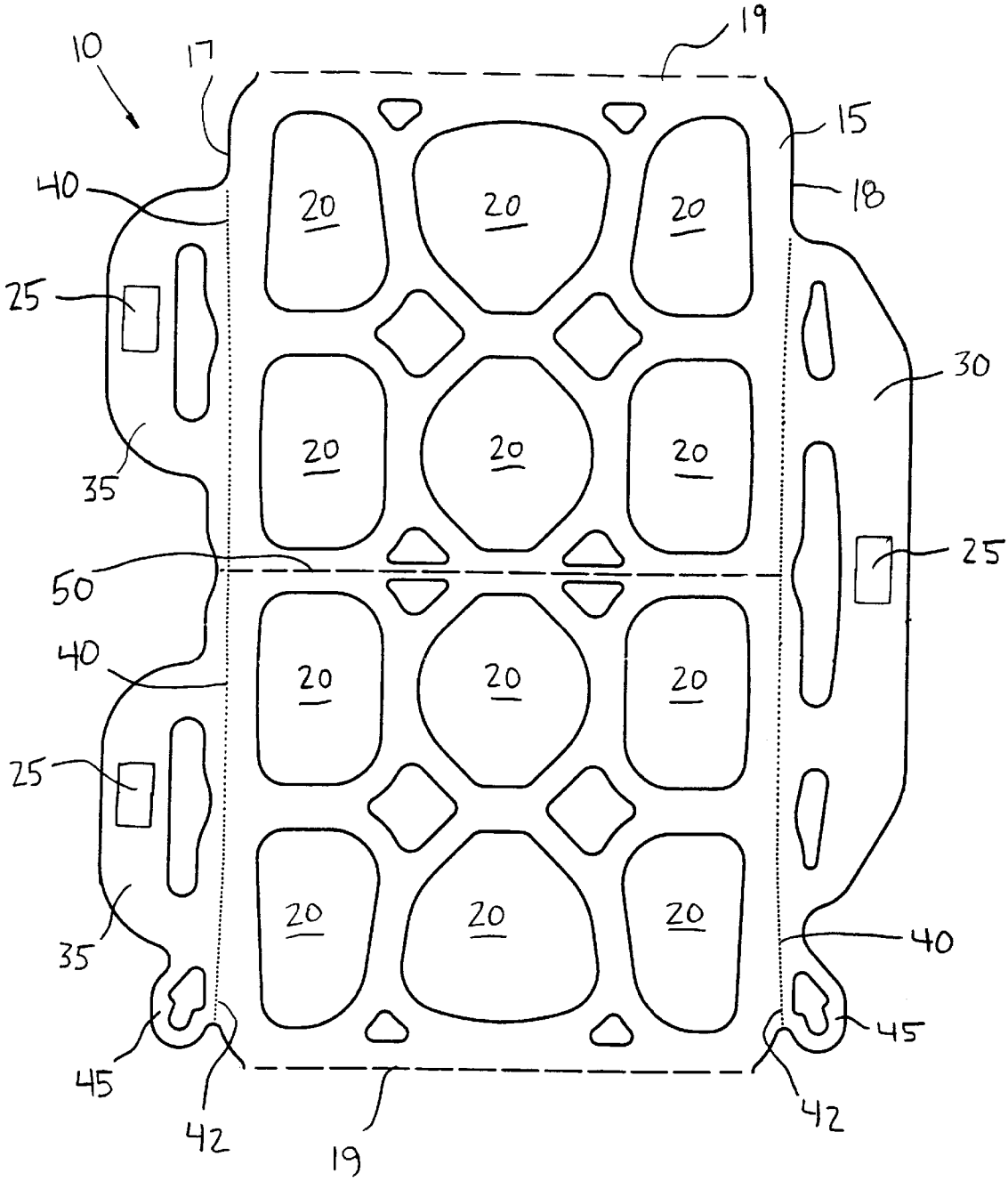
FIG. 1 is a top view of a container carrier according to one preferred embodiment of this invention.
Figure 2:
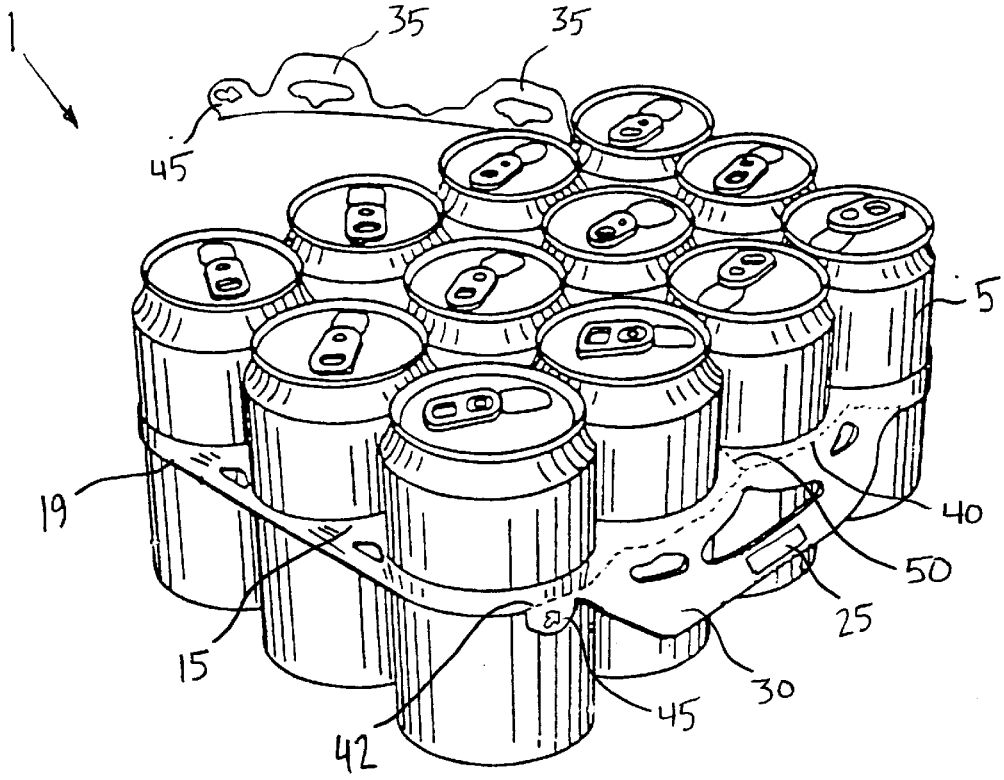
FIG. 2 is a perspective view of a package of 12 containers using the container carrier shown in FIG. 1.
Figure 3:
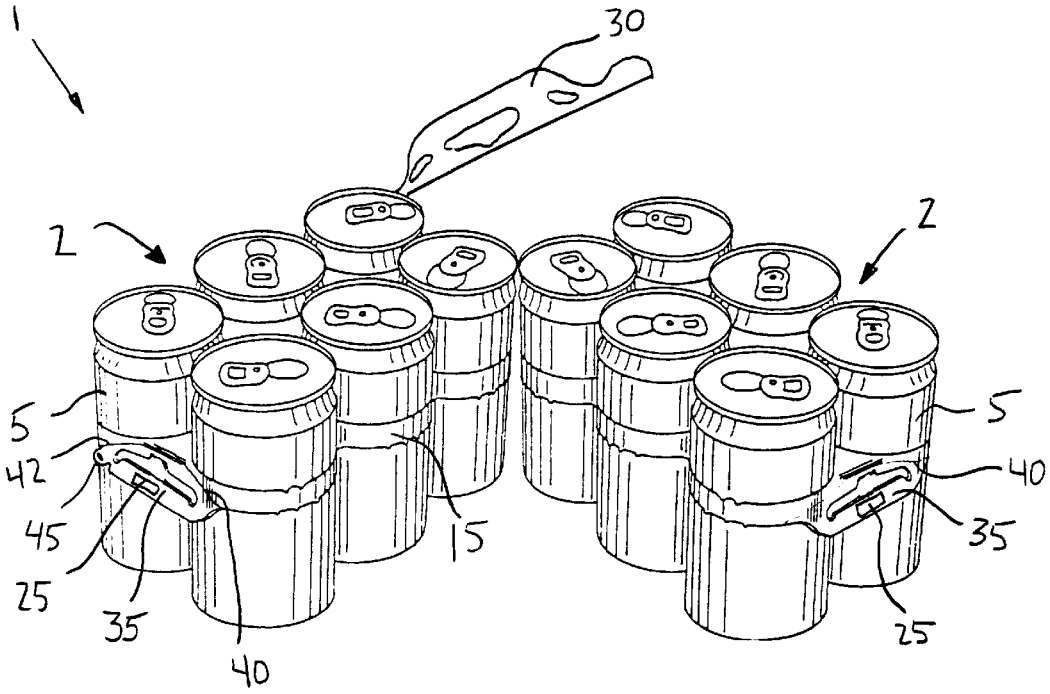
FIG. 3 is a perspective view of two sub-packages of 6 containers using the container carrier shown in FIG. 1.

FIG. 1 shows carrier 10 for carrying a plurality of containers 5. Containers 5 shown in FIGS. 2 and 3 are preferably cans or bottles or other containers used in multi-packaging. Containers 5 are preferably like-sized within a single carrier 10.

Carrier 10 unitizes a plurality of containers 5 to create package 1, such as package 1 shown in FIG. 2. Carrier 10 comprises planar sheet 15 having first edge 17, second edge 18 and two lateral edges 19. Sheet 15 is preferably constructed from a flexible, resilient material such as plastic. In one preferred embodiment of this invention, sheet 15 is made from low- to medium-density polyethylene.

Figure 4:
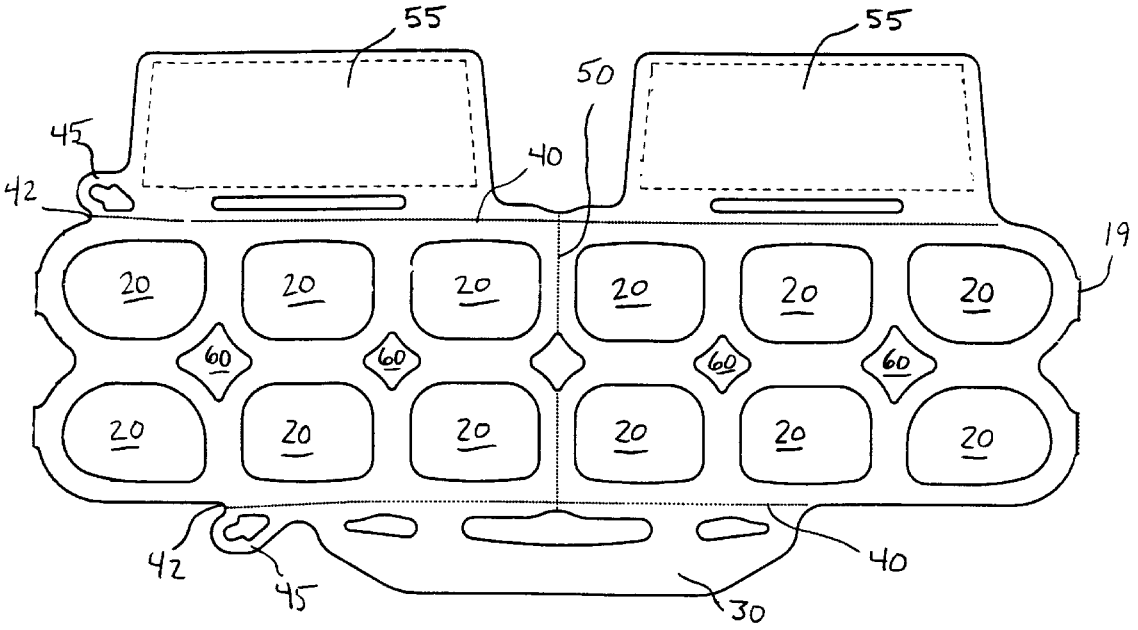
FIG. 4 is a top view according to another preferred embodiment of this invention.

Sheet 15 of material is preferably cut, using means known to those skilled in the art, such as a stamping die, to form a plurality of container receiving openings 20 in sheet 15. Container receiving openings 20 are preferably sized to stretchingly engage with containers 5 to form package 1. In one preferred embodiment of this invention, shown in FIGS. 1–3, container receiving openings 20 are formed in three longitudinal rows and four lateral ranks resulting in twelve container receiving openings 20. Alternatively, as shown in FIG. 4, container receiving openings 20 may be formed in two longitudinal rows of six lateral ranks resulting in twelve container receiving openings. Container receiving openings 20 may be arranged in any other feasible arrangement of longitudinal rows and lateral ranks preferred by consumers and merchandisers.

Carrier 10 further comprises carrier tear line 50 extending across sheet 15. Carrier tear line 50 may be formed with a series of slits or perforations through sheet 15 or a reduced thickness of sheet 15. Preferably, carrier tear line 50 is configured so that sheet 15 does not split along carrier tear line 50 without an intentional tearing by the user. In one preferred embodiment of this invention, carrier tear line 50 divides carrier 10 into equal numbers of container receiving openings 20.

Additionally, at least one handle 30, 35 is integrally formed with sheet 15. As shown in FIG. 1 in one preferred embodiment of this invention, 12 pack handle 30 is positioned along second edge 18 of sheet 15. Also shown in FIG. 1, two 6 pack handles 35 are integrally formed along first edge 17 of sheet 15. As used in the specification and claims herein, integrally formed means handle 30, 35 is included with sheet 15 during manufacturing as a single-piece unit.

As shown in FIGS. 1–3, carrier 10 comprises three handles 30, 35, however, carrier 10 may comprise any number of handles 30, 35 such as one 24 pack handle and four 6 pack handles 35 or, as shown in FIG. 4, one 12 pack handle 30 and zero 6 pack handles.

In one preferred embodiment of this invention, shown in FIG. 4, carrier 10 comprises one 12 pack handle 30 and two panels 55 in lieu of two 6 pack handles as shown in FIG. 1. Panel 55 may be used to display product information, promotional information, pricing information or any other merchandising information. In the preferred embodiment of this invention shown in FIG. 4, individual 6 pack sub-packages 2 may be carried using center apertures 60. In an alternative embodiment of this invention not shown in the drawings, carrier 10 may comprise two 6 pack handles 30 positioned along an opposite edge of carrier 10 as a single panel 55.

Each handle 30, 35 preferably additionally comprises label 25 or other means for pricing package 1. Label 25 may be a UPC label or a price tag affixed with respect to handle 30, 35. Preferably, label 25 contains different pricing information depending upon the size of handle 30, 35 and thus the size of package 1. Therefore, for example, handle 30 contains pricing information for a 12 pack price on label 25 and handle 35 contains pricing information for a 6 pack price on label 25.

Handle 30, 35 is preferably removable along handle tear line 40. Handle tear line 40 is preferably formed between each handle 30, 35 and sheet 15. Therefore, in the preferred embodiment of this invention shown in FIGS. 1–3, sheet 15 comprises two handle tear lines 40, one handle tear line along first edge 17 of sheet 15 and one handle tear line along second edge 18 of sheet 15.

Handle tear line 40 may be formed with a series of slits or line of perforations through sheet 15 or a reduced thickness of sheet 15. Preferably, handle tear line 40 is strong enough to withstand the stresses induced by carrying package 1 or sub-package 2 with handle 30, 35. In one preferred embodiment of this invention, handle tear line 40 comprises a series of slits having an unequal distribution. As shown in FIG. 1, handle tear line 40 may comprise slits or perforations which are spaced apart farther in areas of carrier 10 that absorb higher stress levels. Such slits or perforations in handle tear line 40 are closely packed in those areas of carrier 10 that absorb lower stress levels.

Preferably, handle tear line 40 is configured so that sheet 15 does not split along handle tear line 40 without an intentional tearing by the user. Such an intentional tearing by the user may be facilitated by pull tab 45. Pull tab 45 is preferably integrally formed with sheet 15 and positioned at first end 42 of handle tear line 40. As shown in FIG. 1, pull tab 45 preferably protrudes from sheet 15 and/or handle 30, 35 and is labeled with an arrow or other directional indication for the user. Preferably, when the user pulls pull tab 45, tearing of handle tear line 40 is initiated.

After carrier 10 is filled with containers 5, package 1 is preferably distributed to consumers. Depending on the sales of a merchandiser, package 1 may be sold as is, as shown in FIG. 2, or sold in separate sub-packages 2, as shown in FIG. 3. Package 1 is divisible through carrier tear line 50 into sub-packages 2.

As described above, each handle 30, 35 preferably comprises label 25. In the preferred embodiment of this invention shown in FIGS. 2 and 3, package 1 contains three labels 25, two labels 25 containing 6 pack pricing information on handles 35 and one label 25 containing 12 pack pricing information on handle 30. Package 1 may include any combination of one or more labels 25 effective for conveying pricing information depending upon the configuration of package 1.

If the merchandiser or the consumer needs a 12 pack, shown in FIG. 2, then handles 35 are removed from package 1 through handle tear line 40 along first edge 17 of sheet 15. Package 1 is then carried using handle 30. Package 1 is scanned or rung up at the cash register using label 25 on handle 30 containing price information for a 12 pack.

If the merchandiser or the consumer needs one or more 6 packs, shown in FIG. 3, handle 30 is removed through handle tear line 40 along second edge 18 of sheet 15. Package 1 is then divided along carrier tear line 50 into at least two sub-packages 2. Each sub-package 2 is then independently saleable and portable using handle 35. Sub-packages 2 are scanned or rung up at the cash register using label 25 containing price information for a 6 pack.

FIGS. 2 and 3 show 12 pack and 6 pack configurations of package 1 and sub-package 2, however, this invention may apply to any combination of package 1 divisible into two or more sub-packages 2. For instance, this invention may apply to packages 1 of twelve or eight containers 5 divisible into individual sub-packages 2 of four containers 5 or cases of containers 5 divisible into individual sub-packages 2 of six containers 5.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

I claim:

1. A carrier for carrying a plurality of containers, the carrier comprising:

a sheet having a plurality of container receiving openings;

at least two carrying handles integrally formed with the sheet and attached to opposite edges of the sheet, the at least two carrying handles are removable along a handle tear line and capable of supporting the plurality of containers; and a carrier tear line extending across the sheet dividing the carrier into two or more sub-packages, at least one of the two carrying handles extending across the carrier tear line.

2. The carrier of claim 1 comprising three handles.

3. The carrier of claim 2 wherein at least two handles are positioned along a first edge of the sheet.

4. The carrier of claim 1 wherein the carrier tear line comprises a line of perforations.

5. The carrier of claim 1 wherein the handle tear line comprises a line of perforations.

6. The carrier of claim 5 wherein the handle tear line comprises a series of slits having an unequal distribution.

7. The carrier of claim 1 further comprising a pull tab formed along a first end of the handle tear line.

8. The carrier of claim 1 having two handle tear lines.

9. The carrier of claim 1 wherein the plurality of container receiving openings are arranged in three longitudinal rows of four lateral ranks.

10. The carrier of claim 1 wherein the plurality of container receiving openings are arranged in two longitudinal rows of six lateral ranks.

11. The carrier of claim 1 further comprising at least one panel integrally formed with the sheet.

12. The carrier of claim 11 wherein the panel is removable along a tear line.

13. A carrier for carrying a plurality of containers, the carrier comprising:

a sheet having a first edge, a second edge and a plurality of container receiving openings, the sheet divisible into two or more sub-packages along a carrier tear line; and at least two carrying handles integrally formed with the sheet, at least one carrying handle positioned along the second edge and extending across the carrier tear line, the at least one carrying handle capable of supporting at least one container of the plurality of containers and removable along a handle tear line.

14. The carrier of claim 13 wherein the handle tear line comprises a series of slits having an unequal distribution.

15. The carrier of claim 13 wherein said at least two carrying handles are integrally formed along a first edge of the sheet.

16. The carrier of claim 13 having two handle tear lines.

17. A method for packaging a plurality of containers within a divisible package, the method comprising:

applying at least two different pricing labels to separate carrying handles positioned along each side of the divisible package;

simultaneously removing at least one carrying handle capable of supporting the divisible package of at least two carrying handles and one pricing label of the at least two different pricing labels from the divisible package along a handle tear line; and allowing the divisible package to be divided into at least two sub-packages along a carrier tear line, at least one carrying handle extending across the carrier tear line.

18. The method of claim 17 wherein one pricing label of the at least two different pricing labels is applied to the at least one handle.

19. A unitized package of a plurality of containers, the package comprising:

a sheet having a plurality of container receiving openings, each container receiving opening engaging a container of the plurality of containers, the sheet divisible into two or more sub-packages of containers along a carrier tear line; and a plurality of carrying handles integrally formed with the sheet, at least one carrying handle centered along the package and extending across the carrier tear line, at least one other carrying handle positioned along an opposite edge of the package, the plurality of carrying handles each for supporting one or more of the plurality of containers and each removable along a handle tear line.

20. A carrier for carrying a plurality of containers, the carrier comprising:

a sheet having a plurality of container receiving openings that each engage a container of the plurality of containers to form a package;

two carrying handles integrally formed with one edge of the sheet and one carrying handle integrally formed with an opposite edge of the sheet, each carrying handle capable of supporting at least one container of the plurality of containers and removable along a handle tear line; and a carrier tear line extending across the sheet dividing the carrier into two or more sub-packages, the one carrying handle integrally formed with the opposite edge of the sheet extending across the carrier tear line.

* * * * *